US010240861B2

(12) United States Patent
Sugar et al.

(10) Patent No.: US 10,240,861 B2
(45) Date of Patent: Mar. 26, 2019

(54) COLD STORAGE HEALTH MONITORING SYSTEM

(71) Applicant: Emanate Wireless, Inc., Ijamsville, MD (US)

(72) Inventors: Gary L. Sugar, Shaker Heights, OH (US); Yohannes Tesfai, Silver Spring, MD (US); Neil R. Diener, Hudson, OH (US)

(73) Assignee: Emanate Wireless, Inc., Ijamsville, MD (US)

( * ) Notice: Subject to any disclaimer, the term of this patent is extended or adjusted under 35 U.S.C. 154(b) by 0 days.

(21) Appl. No.: 16/054,208

(22) Filed: Aug. 3, 2018

(65) Prior Publication Data

US 2018/0340729 A1 Nov. 29, 2018

Related U.S. Application Data

(63) Continuation-in-part of application No. 15/727,771, filed on Oct. 9, 2017, now abandoned.

(60) Provisional application No. 62/456,897, filed on Feb. 9, 2017, provisional application No. 62/409,947, filed on Oct. 19, 2016.

(51) Int. Cl.

| | |
|---|---|
| ***F25D 29/00*** | (2006.01) |
| ***G08B 21/18*** | (2006.01) |
| ***F25D 21/00*** | (2006.01) |

(52) U.S. Cl.

CPC ..... *F25D 29/008* (2013.01); *F25D 21/006* (2013.01); *G08B 21/182* (2013.01); *F25D 2700/08* (2013.01); *F25D 2700/12* (2013.01); *F25D 2700/14* (2013.01)

(58) Field of Classification Search

None

See application file for complete search history.

(56) References Cited

U.S. PATENT DOCUMENTS

| | | | | |
|---|---|---|---|---|
| 3,976,985 | A * | 8/1976 | Schalow | F25D 29/008 340/521 |
| 4,325,223 | A | 4/1982 | Cantley | |
| 4,502,287 | A | 3/1985 | Hare et al. | |
| 5,402,112 | A | 3/1995 | Thompson | |
| 8,725,455 | B2 | 5/2014 | Kriss | |
| 9,020,769 | B2 | 4/2015 | Rada et al. | |
| 2007/0156373 | A1* | 7/2007 | Yamashita | F25B 49/005 702/182 |
| 2008/0209925 | A1 | 9/2008 | Pham | |
| 2011/0144944 | A1 | 6/2011 | Pham | |
| 2014/0165614 | A1 | 6/2014 | Manning et al. | |
| 2014/0324388 | A1 | 10/2014 | Kriss | |

* cited by examiner

*Primary Examiner* — Brent Swarthout

(74) *Attorney, Agent, or Firm* — Edell, Shapiro & Finnan, LLC

(57) ABSTRACT

A monitoring system for a cold storage device such as a vapor compression refrigerator or freezer. The monitoring system learns operating characteristics of the cold storage device and issues alarm notifications when abnormal behavior is detected. Such a system can be used as an "early warning system" to flag when a cold storage device is not operating properly. Such a system could be particularly valuable in applications that make mission-critical use of cold storage devices, e.g., biomedical or pharmaceutical research labs, blood or tissue banks, grocery stores, restaurants, and the like.

20 Claims, 14 Drawing Sheets

1050

| Compressor | Defroster | Door Light | Cluster | Decision Region |
|---|---|---|---|---|
| Off | Off | Off | 905 | 1005 |
| Off | Off | On | 910 | 1010 |
| Off | On | Off | 915 | 1015 |
| Off | On | On | 920 | 1020 |
| On | Off | Off | 925 | 1025 |
| On | Off | On | 930 | 1030 |

FIG. 13

COLD STORAGE HEALTH MONITORING SYSTEM

CROSS-REFERENCE TO RELATED APPLICATIONS

This application is a continuation-in-part of U.S. application Ser. No. 15/727,771, filed Oct. 9, 2017, which in turns claims the benefit of U.S. Provisional Patent Application No. 62/409,947, now abandoned, "Machine Learning Algorithms for Health Monitoring of Refrigerators, Freezers and Other Temperature Control Systems," filed Oct. 19, 2016, and of U.S. Provisional Patent Application No. 62/456,897, "Misc Enhancements To Refrigerator Operating State Detection Algorithms," filed Feb. 9, 2017, both of which are incorporated by reference herein in their entirety.

FIELD OF THE INVENTION

The present disclosure relates to monitoring electrical current consumption and temperature characteristics of cold storage devices to learn their operating behavior and to signal an alarm indication when abnormal behavior is detected.

BACKGROUND OF THE INVENTION

Cold storage devices such as refrigerators and freezers play a mission-critical role in settings such as medical research labs and tissue banks, where an overnight malfunction can put many years of research and investment dollars to waste. In settings such as these, there is a clear need for automated remote health monitoring of these cold storage devices to provide stakeholders with an early warning indication if any abnormalities are detected.

SUMMARY OF THE INVENTION

In one form, the present disclosure describes a cold storage monitoring system that monitors the temperature inside and electrical current supplied to a cold storage unit such as a refrigerator or freezer, learns how the system behaves in a normal or baseline state, and signals an alarm indication when abnormal behavior is detected.

More specifically, a process is provided that includes monitoring one or more of the electrical current consumption of and temperature inside a cold storage device. Several embodiments of a monitoring device are described herein to obtain signals/data representing the electrical current consumption of and temperature inside a cold storage device. The process includes identifying operational state changes of the cold storage device using detected changes in the electrical current consumption, and calculating a feature vector of electrical and thermal properties of the cold storage device between two consecutive operational state changes. Furthermore, the process includes a learning process that includes: accumulating the feature vectors over a period of time; identifying clusters of accumulated feature vectors; associating one or more functional operating states of the cold storage device with one or more of the clusters; calculating learning statistics based on one or more of: a frequency that the cold storage device enters the one or more functional operating states or a variation of a feature vector parameter within one or more of the clusters; and generating an alarm threshold from the learning statistics; The process also includes a monitoring process that includes: determining a nearest cluster to the feature vector; determining one or more current functional operating states of the cold storage device from the functional operating states associated with the nearest cluster; calculating a monitoring statistic based on one or more of: the one or more current functional operating states or one or more feature vector components/elements; and sending an alarm notification if the monitoring statistic exceeds the alarm threshold.

BRIEF DESCRIPTION OF THE DRAWINGS

The foregoing and other features of the present disclosure will become apparent to those skilled in the art to which the present disclosure relates upon reading the following description with reference to the accompanying drawings.

FIG. 7 is an example plot of the RMS current consumption vs. time of a refrigerator/freezer combination device during a single refrigeration cycle in which a defrost heater is turned on.

FIG. 13 shows which functional operating states are associated with each of the 6 feature vector clusters and decision regions shown in FIG. 12*a* and FIG. 12*b*, in accordance with an example embodiment.

DETAILED DESCRIPTION OF THE INVENTION

The present disclosure relates generally to a monitoring system for a cold storage device such as a vapor compression refrigerator or freezer. The monitoring system learns operating characteristics of the cold storage device and issues alarm notifications when abnormal behavior is detected. Such a system can be used as an "early warning system" to flag when a cold storage device is not operating properly. Such a system could be particularly valuable in applications that make mission-critical use of cold storage devices, e.g., biomedical or pharmaceutical research labs, blood or tissue banks, grocery stores, restaurants, and the like.

Figure 1:
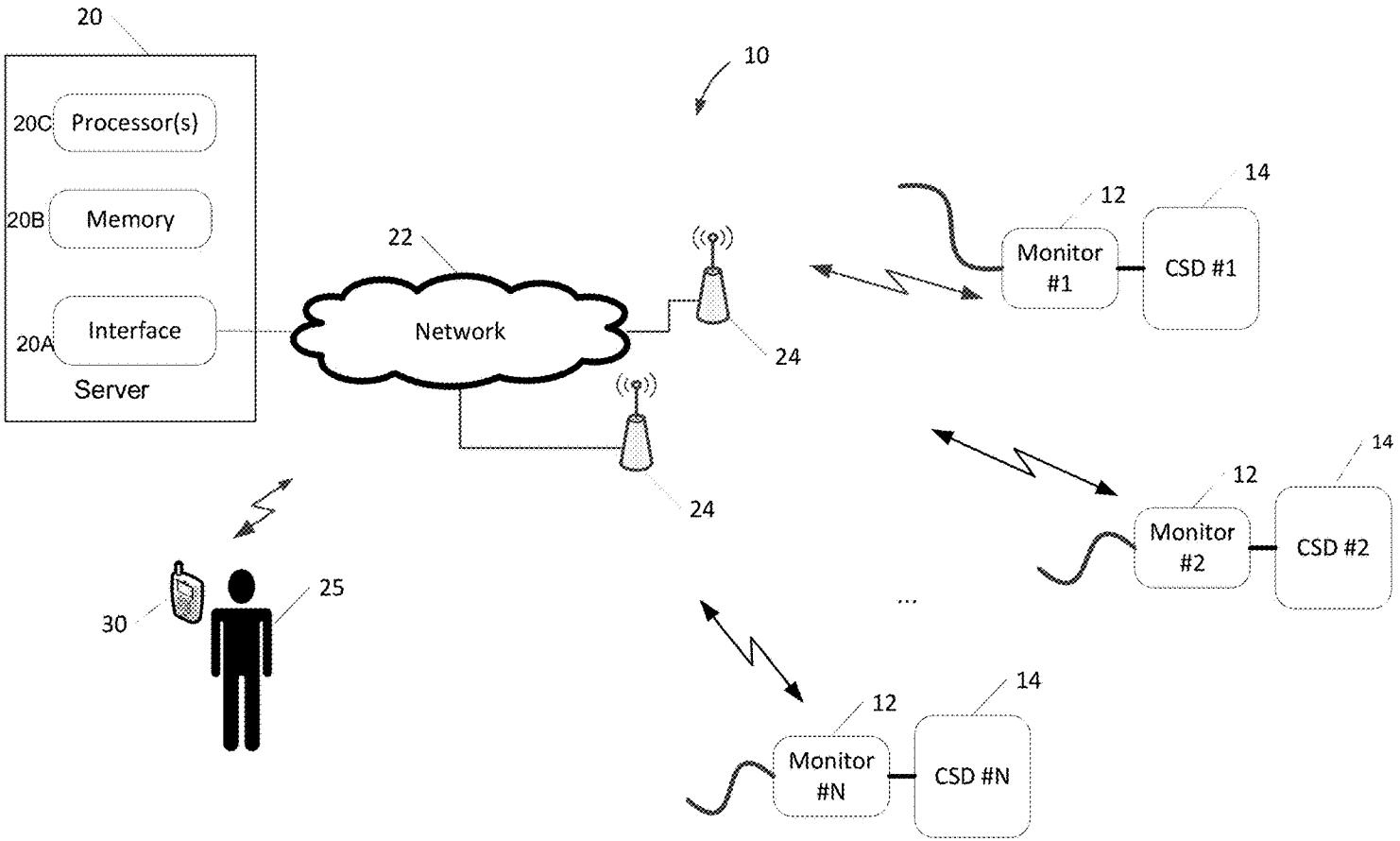
FIG. 1 is a block diagram showing a system that can employ one or more cold storage monitors that can each monitor electrical and thermal properties of a host cold storage device such as a refrigerator or freezer in accordance with an example embodiment.

Referring to FIG. 1, an example of a system 10 employing a plurality of cold storage monitors 12 to monitor the health of their attached cold storage devices 14 is shown. Example cold storage devices include refrigerators, freezers, refrigerator/freezer combination devices, and the like. Each monitor 12 is equipped with a Wi-Fi transceiver that allows it to periodically report measurements and status to a cloud server 20 through network 22 to which one or more wireless access points 24 may be connected to provide wireless connectivity between the monitors 12 and the server 20. The server 20 may at times send alert notifications to users 25 through a smartphone 30 or similar mobile device or non-mobile device, such as a desktop computer that has connectivity to the server 20.

The server 20 includes a communication interface (e.g., network interface card(s)) 20A, memory 20B and one or more processors 20C. The memory 20B may take the form of any non-transitory computer readable storage media, such as random access memory, read only memory, etc. The memory 20B may store or be encoded with instructions that, when executed by the one or more processors 20C, cause the one or more processors 20C to perform the server operations described herein.

Figure 2:
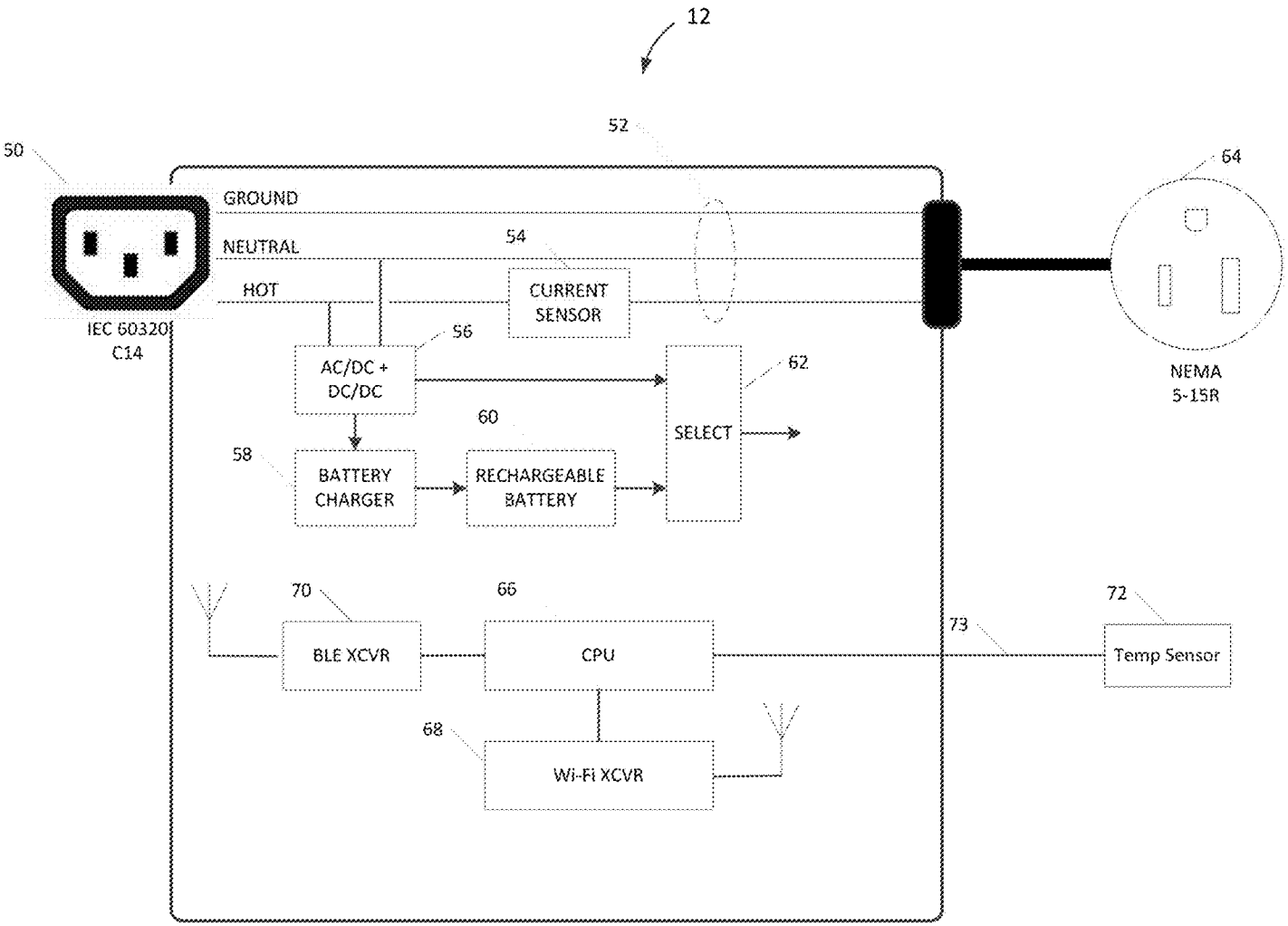
FIG. 2 is a schematic diagram of a cold storage monitor that has a 3-wire alternating current (AC) pass-through connection between an AC mains and a host cold storage device, and a wired temperature probe in accordance with an example embodiment.

Referring to FIG. 2, with continued reference to FIG. 1, a cold storage monitor 12 can be configured to have a "pass-through" connection 52 for electrical AC power. In this case the monitor 12 may have an IEC 60320 C14 connector 50 that connects to an AC mains via a power cable with a matching IEC 60320 C13 connector. The monitor 12 could provide electrical power to a host cold storage device 14 through its output power connector 64 which, in North America, might be a NEMA 5-15R connector. The monitor 12 has a current sensor 54 to measure the electrical current being consumed by the host device 14. The current sensor 54 is digitally sampled at at least twice the AC mains frequency of 50-60 Hz. The monitor 12 may also have an AC-to-DC converter 56, a battery charger 58 and rechargeable battery 60. The AC-to-DC converter 56 can be used to recharge the battery and power the monitor's active electronics. The battery 60 is used to power the monitor 12 in the event of an AC power outage or if the monitor is accidentally unplugged. A selector 62 may select either the power output by the converter 56 or by the battery 60. The monitor 12 may use a Wi-Fi transceiver 68 to communicate temperature, electrical current and other measurement data or calculated parameters and alarm notification messages with the server 20 via network 22 or the internet.

FIG. 2 shows that the monitor 12 may include a Bluetooth Low Energy (BLE) via a BLE transceiver 70 and a temperature sensor 72 configured to measure the temperature inside the cold storage device. The temperature sensor 72 may either be connected directly to the monitor 12 via a cable connection 73, or by way of a wireless connection such as that provided by the BLE transceiver 70. In some applications, multiple temperature sensors could be used. For example, one temperature sensor could measure the temperature in the freezer compartment and another could measure the temperature in the refrigerator compartment in a refrigerator/freezer combination device. Another example would be to use one temperature sensor inside and another outside a refrigerator. Yet another example would be to measure the temperature at multiple positions within a refrigerator using multiple temperature sensors.

The monitor 12 may include a processor or central processing unit (CPU) 66 configured to execute instructions to, among other things, determine the operating state of the cold storage device using the measurement data obtained from the current sensor 54 and temperature sensor 72, characterize the behavior of these sensor signals over time, and send alarm notifications to the server 20 via the Wi-Fi transceiver 68 if abnormal behavior is detected.

The a BLE transceiver 70 may be used to pass measurement data and/or configuration data between the monitor's processor 66 and an external smartphone, tablet computing device or other portable/mobile device. Another potential use for the BLE transceiver 70 is to read measurement data from one or more external wireless sensors such as temperature, humidity, or air pressure sensors that support the BLE protocol.

Figure 3:
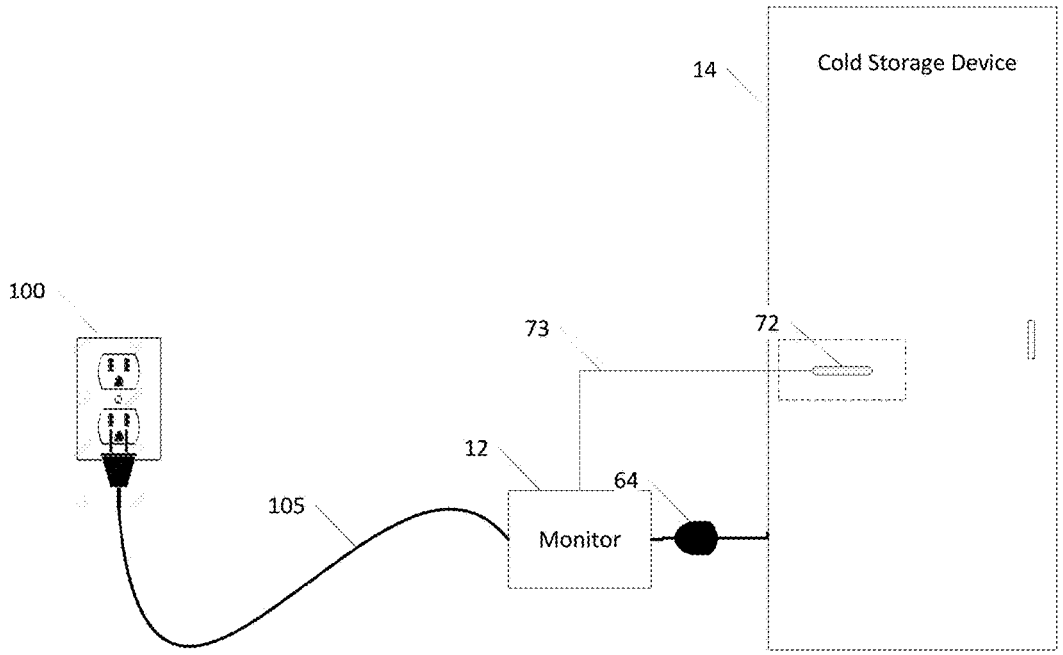
FIG. 3 is a block diagram showing how the cold storage monitor of FIG. 2 can be used to monitor the electrical current supplied to, and temperature inside of, a cold storage device, in accordance with an example embodiment.

Reference is now made to FIG. 3, with continued reference to FIG. 2. FIG. 3 shows how a pass-through monitor could connect to a cold storage device 14. A power cable 105 connected to an AC mains through electrical outlet 100 on one side could plug into the male IEC 60320 C14 connector 50 of the monitor 12 using an IEC 60320 C13 connector on the opposite side of the cable 105. The cold storage device's NEMA 5-15p power plug could plug into the NEMA 5-15r receptacle 64 on the monitor 12. The monitor's temperature sensor 72 could be placed inside the cold storage device 14. The wire 73 connecting the temperature sensor 72 to the monitor 12 could be inserted into the cold storage device behind the door gasket on the hinged side of door of the cold storage device.

Figure 4:
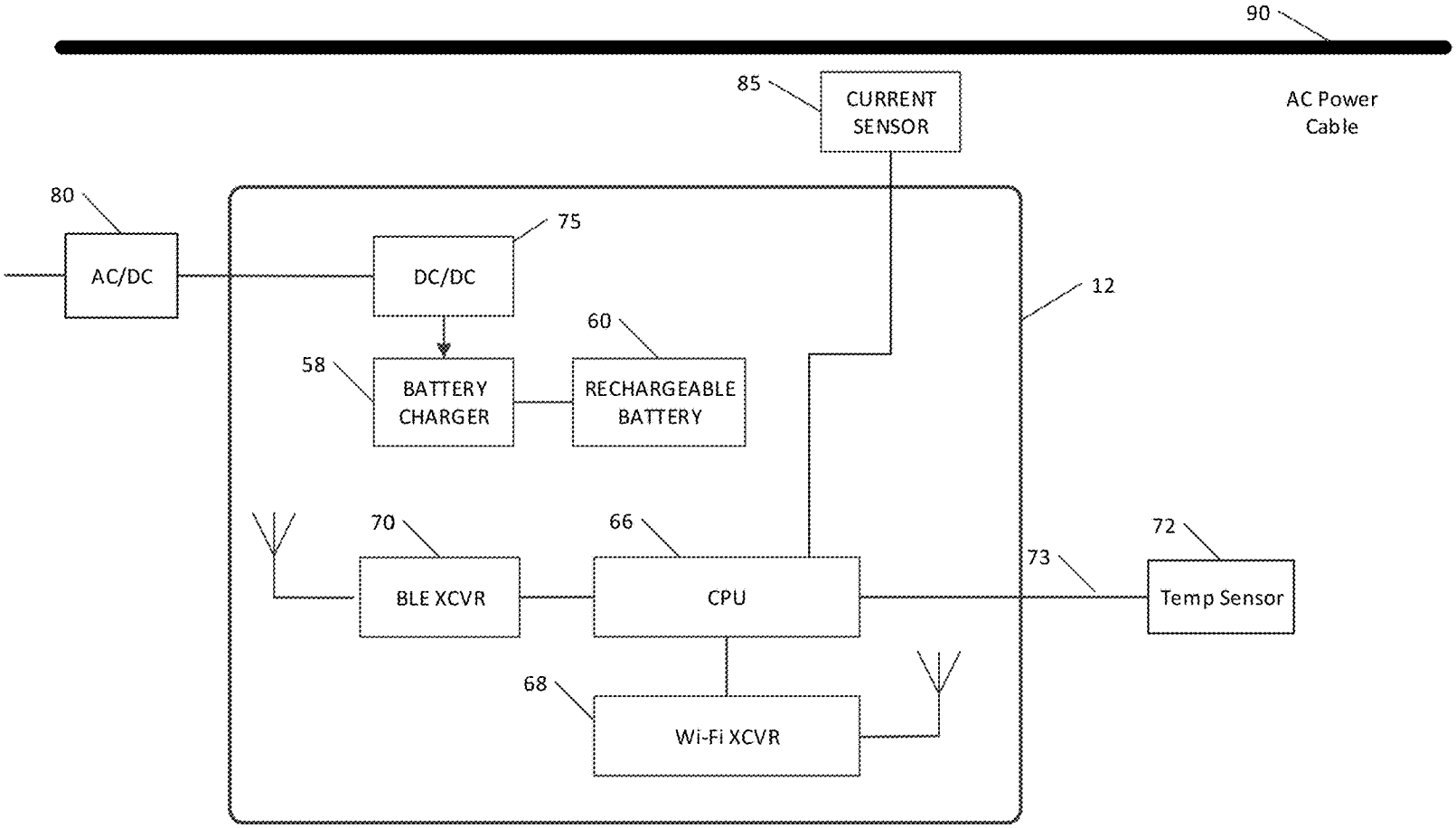
FIG. 4 is a schematic diagram of a cold storage monitor that has wired connections to a magnetic current probe and a temperature probe that can measure the electrical current supplied to and temperature inside a cold storage device, in accordance with an example embodiment.

FIG. 4 shows a different embodiment of the monitor 12 that supports an external electrical current sensor 85 instead of the pass-through sensor 54 described in connection with FIG. 2. Since the pass-through power connection is not available in this case, the monitor 12 could be powered instead via an external AC-to-DC converter 80 that plugs into a wall power outlet. A magnetic current sensor 85 could be placed on the exterior of the AC power cable 90 connecting the cold storage device 14 to an AC mains. An algorithm for using a magnetic current sensor in this way is described in U.S. patent application Ser. No. 15/601,223, entitled "Active RFID Asset Tracking Tag with Current-Sensing Cable Clamp", filed on May 22, 2017, which is incorporated herein by reference. Using a magnetic current sensor placed on the exterior of the AC cable is advantageous to other current sensing approaches because it is unobtrusive i.e., it does not require the cable 90 to be modified mechanically or electrically to support the current sensor in any way. The current sensor 85 can be connected to the monitor 12 via a cable connection as shown in FIG. 3, or alternatively via a wireless connection such as BLE.

Figure 5A:
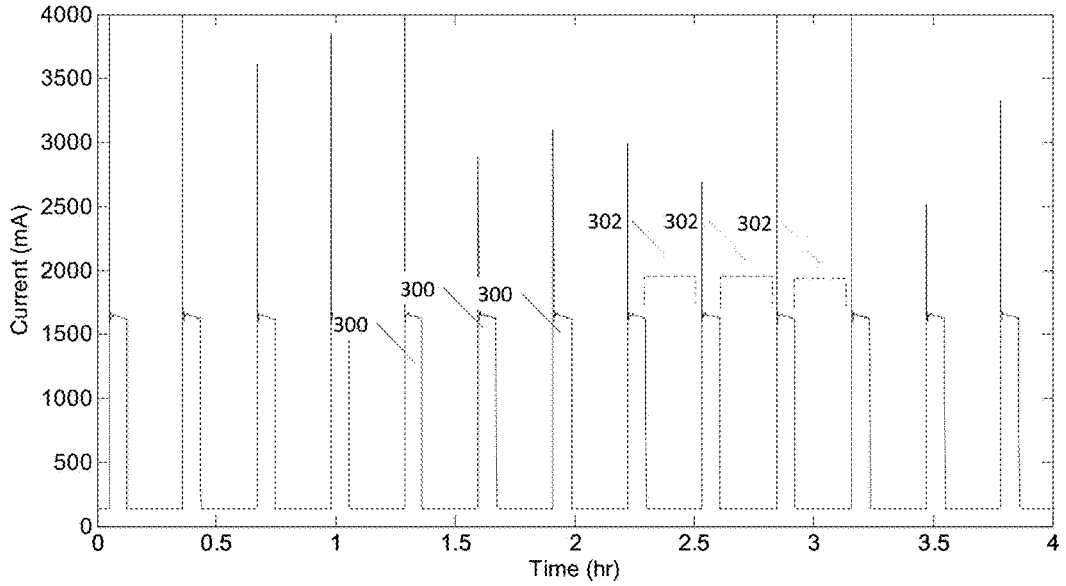
FIG. 5*a* is an example plot of the root-mean-squared (RMS) current consumption vs. time of a refrigerator showing a number of refrigeration cycles.
Figure 5B:
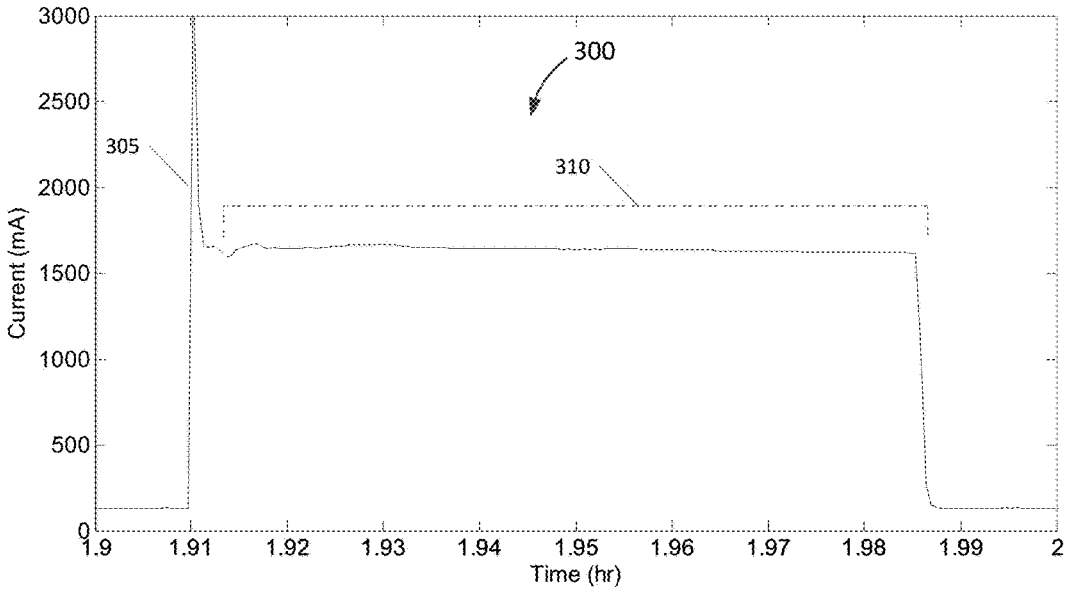
FIG. 5*b* is a zoomed in view of one of the refrigeration cycles shown in FIG. 5*a*.

Turning now to FIGS. 5*a* and 5*b*, the root-mean-square (RMS) current level vs. time for a typical lab cold storage device (e.g., refrigerator) is shown. FIG. 5*a* shows a periodic sequence of current "pulses" 300 each having a period of approximately 20 minutes. Each of these pulses is associated with a "compressor on" condition in the cold storage device. The compressor in most cold storage devices is an electrically powered piston motor. When the motor first powers up, there is a large spike or transient in current consumption; this initial current spike 305 is sometimes referred to as "lock rotor current" in the electrical and mechanical engineering literature. After the initial spike, the current settles down to a steady-state level 310, which is referred to herein as the compressor's "post-transient" or "post-power-up" current level.

Figure 6:
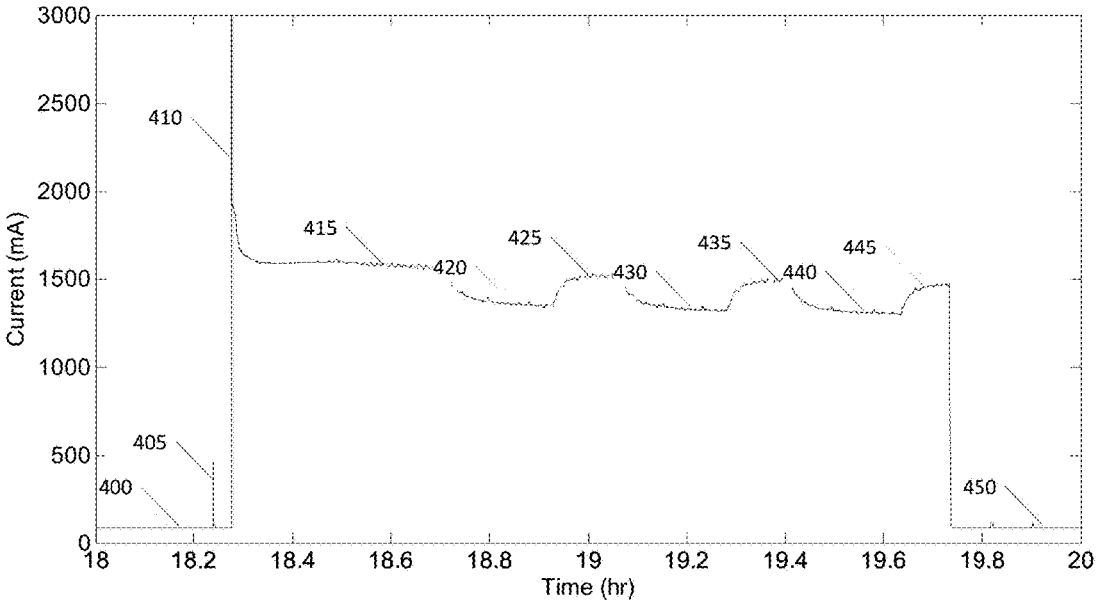
FIG. 6 is an example plot of the RMS current consumption vs. time of a refrigerator/freezer combo unit during a single refrigeration cycle.

FIG. 6 shows the current waveform for a single refrigeration cycle from a refrigerator/freezer combination cold storage device. Such cold storage devices are typically used for food storage in a hospital nursing unit or in residential applications. In this example, the familiar large current spike indicating the compressor has turned on is shown at 410. A smaller (500 mA) and much shorter in duration current spike is shown at 405 just before the compressor turns on. This is from one of the doors being opened, causing a door light to turn on. After the compressor turns on, the current settles down at 415 to a steady state at approximately 1.6 Amps. The exponentially damped current decreases at 420, 430, 440 and increases at 425, 435, 445 are indicative of a damper opening and closing and a cooling fan turning on and off to circulate cold air from the freezer into the refrigerator compartment.

Figure 7:
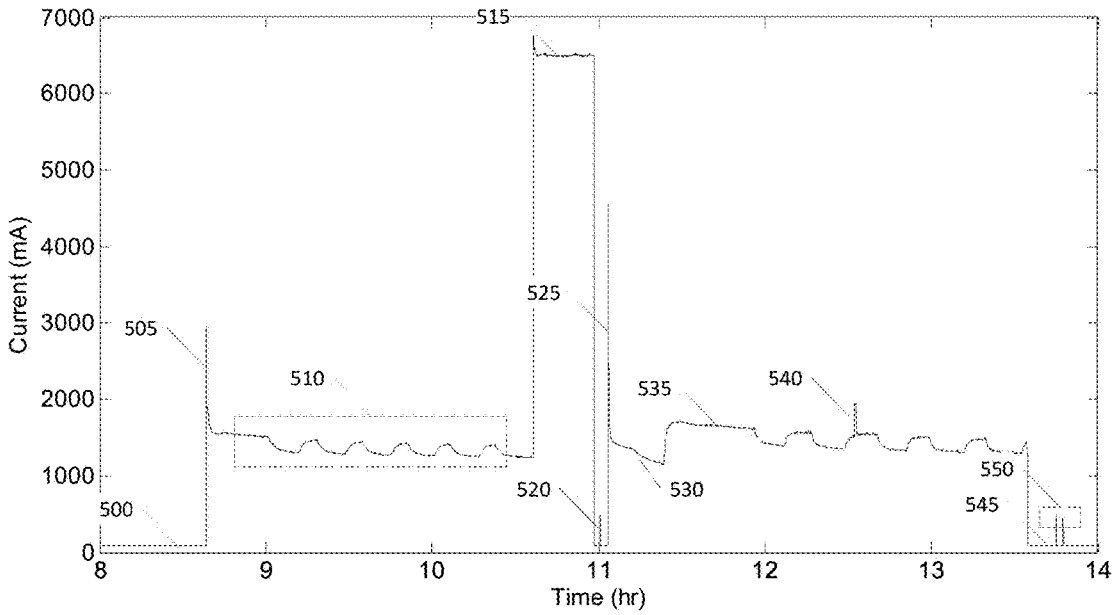

FIG. 7 shows two consecutive refrigeration cycles from the same refrigerator/freezer combination cold storage device as in FIG. 6. At the end of the first cycle, a large current spike is shown at 515 of about 6.5 Amps when the defrost heater turns on. Algorithmically, the defrost heater can be differentiated from the compressor turning on using one or more of the following criteria: (1) the amplitude of the current spike, (2) the amount of post-transient current after the spike, and (3) the change in temperature in the freezer compartment while the compressor or defroster is on; the temperature in the freezer compartment almost always decreases while the compressor is on and increases while the defrost heater is on.

Figure 8:
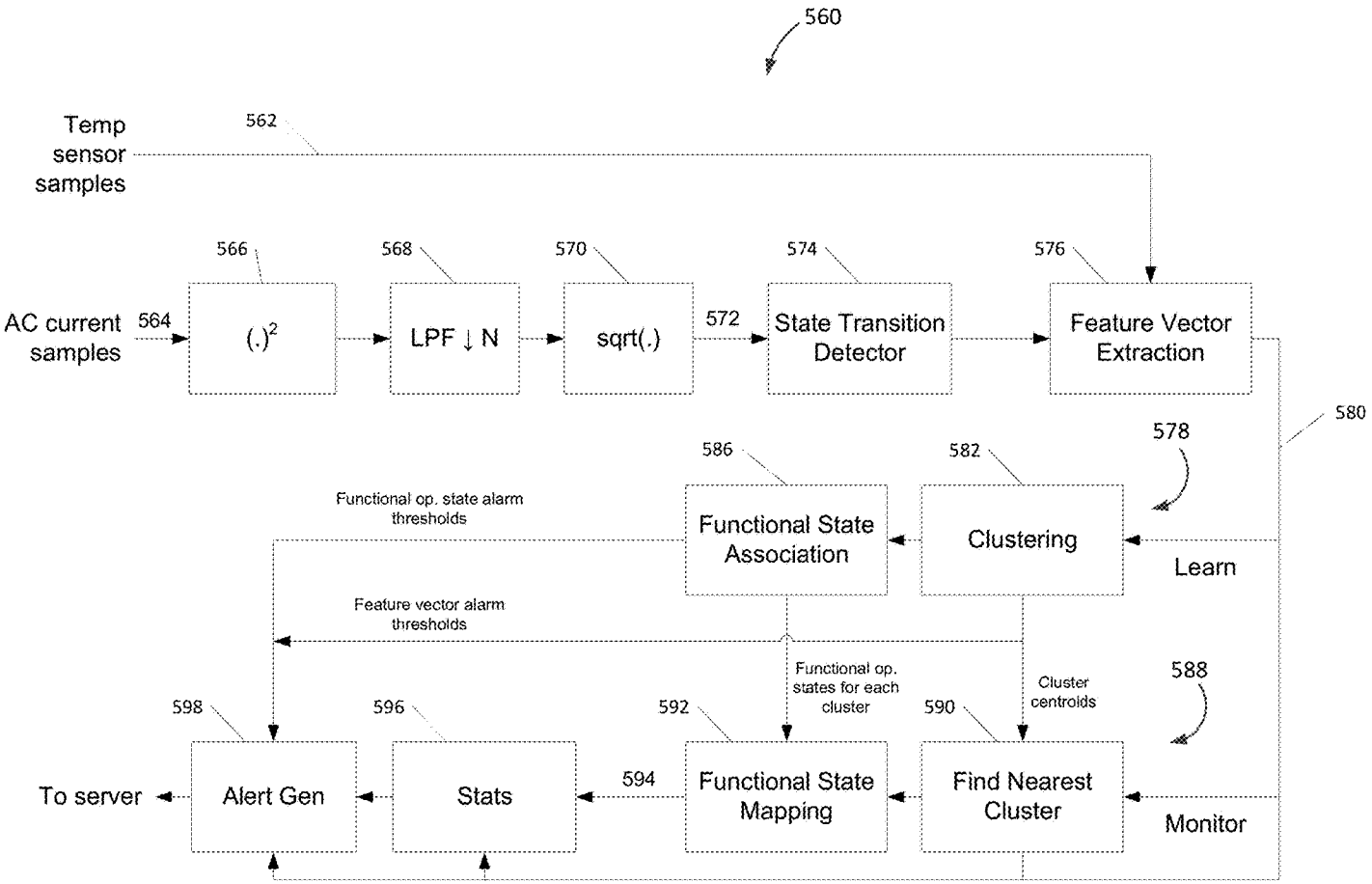
FIG. 8 is a block diagram showing the signal processing and algorithmic flow for the operating state detection algorithms running inside the cold storage monitor, in accordance with an example embodiment.

The monitor 12 uses an operating state detection algorithm to determine the current operating state or states of the cold storage device 14, to learn how the operating state varies over time its behavior over time, and to generate an alarm indication if abnormal behavior is detected. A block diagram showing the signal processing flow of the algorithm is shown in FIG. 8. The algorithm 560 could be executed in the monitor's CPU 66 (FIG. 2).

Referring now to FIG. 8, the algorithm 560 is now described, with continued reference to FIGS. 1 and 2. Temperature sensor samples 562 are supplied as input to the algorithm 560 and used as described below. The digitized AC current samples 564 from current sensor 54 are squared at 566, low pass filtered and decimated at 568 to approximately 100 samples per second, then fed into a square-root block 570, yielding a 100 sample per second RMS current signal 572. The RMS current signal samples 572 are fed into a state transition detector 574 and then a feature vector extraction module 576. The state transition detector 574 detects operating state transitions by looking for discontinuities in either the RMS current waveform or in its derivative. The feature vector extraction module 576 identifies and parameterizes key characteristics of the RMS current waveform and temperature sensor samples 562 from the temperature sensor 72 between two consecutive operating state transitions and stores them in a feature vector. Referring back to FIGS. 5*b* and 6, example feature vector parameters could include: lock rotor current peak overshoot and duration (also referred to herein as transient current overshoot level and duration) 305, post-overshoot min, max or average current level 310; post-overshoot current duration; min, max or average temperature rate-of-change; time since last lock rotor current spike 305.

Turning back to FIG. 8, the algorithm 560 uses a "Learning" process depicted at 578 to learn the operating characteristics of the cold storage device while the cold storage device is known to be in a healthy or reasonably healthy "baseline" state. The learning process 578 includes feeding feature vectors 580 into a clustering module 582, which accumulates the feature vectors over time and identifies clusters of the accumulated feature vectors.

The clustering module 582 feeds key characteristics about each cluster into a "functional state association" module 586 which associates one or more functional operating states of the cold storage device with one or more of the clusters. Examples of functional operating states include: whether a cold storage device's compressor is on, whether its defroster is on, whether a door is opened and a door light is on, whether a refrigerator-to-freezer cooling fan is on and damper is opened, and the like. A feature vector is made of feature vector components, also called feature vector elements. The key characteristics could include the centroid of each cluster; the min and max values for each feature vector component over all feature vectors contained within the cluster; the 90 percent min and max values for each feature vector component, which could be obtained by sorting each feature vector component's values over all feature vectors contained within the cluster, then taking the value that's within 10% of the sorted min or max; or the median of each cluster, which could be obtained by computing the median of each feature vector component value over all feature vectors contained within the cluster. In some cases the key characteristics could include all the feature vectors contained within each cluster.

The clustering and functional state association modules 582 and 586 also take statistics on the accumulated feature vectors and their associated functional operating states and generate one or more alarm thresholds based on this information which are passed on to the "Alert Gen" module 598 to send alarm notifications as part of the monitoring process. In certain cases, the statistics taken on the accumulated feature vectors are often only computed over a subset of one or more clusters. For example, mean compressor current overshoot would only be computed for feature vectors occupying clusters associated with a compressor off to compressor on functional state transition. Example statistics on the associated functional operating states include compressor duty cycle, compressor period, defroster duty cycle and defroster period, compressor steady-state current or on duration, compressor off duration, defroster on current, and defroster on duration.

The algorithm 560 uses a "Monitoring" process depicted at reference numeral 588 to determine the operating state of the cold storage device from the most recently received feature vector, to calculate statistics on the operating state over a period of time, and to signal an alarm indication if a malfunction is detected.

The first part of the Monitoring process 588 is to map a feature vector to its nearest cluster. This mapping process is done in the "Find Nearest Cluster" module 590. The mapping could be done by finding the cluster centroid having the minimum distance to the feature vector, wherein the distance is measured using a Euclidean norm or some other appropriate distance metric. Alternatively, the mapping could be done using decision regions generated from the clustering module 582 during learning. After the nearest cluster is determined, the current functional operating state 594 of the cold storage device is calculated in the "Functional State Mapping" module 592 using the nearest cluster and its associated functional operating state, the mapping for which was computed by the "Functional State Association" module 586.

The current functional operating state 594 is fed into a "Stats" module 596 that computes time-based statistics on the behavior of the functional operating state 594 or one or more of the feature vector 580 components. Examples statistics on the functional operating state include compressor duty cycle, mean compressor on duration, max compressor off duration, defroster duty cycle, and the like. Example statistics on the feature vector components include max/min/mean current overshoot level when compressor on, mean defroster on current, and mean defroster on duration.

The "Alert Gen" module 598 generates alert or alarm indications if it is determined that any of the statistics calculated in the Stats module 596 exceed a threshold. The alarm thresholds used in this calculation are supplied from the "Functional State Association" 586 and "Clustering" 582 modules. The alarm indications could be sent to the server 20 via the Wi-Fi transceiver 68 and then sent from the server to a user via his or her smartphone 30 or other mobile device (FIG. 1). Example alarm indications include: compressor powered on for an unusually large time period, compressor powered off for an unusually large time period, short-term average compressor duty cycle uncharacteristically high or low, long-term average compressor duty cycle uncharacteristically high or low, uncharacteristically low rate of cooling when compressor powered on, abnormal rate of heating when defroster powered on, abnormal rate of heating when compressor powered off, unexpected defroster "on" duration, missing defrost cycle, unexpected defroster "off" duration, irregular compressor power-up transient behavior, irregular compressor current consumption while powered on and unexpected defroster current consumption.

The Learning and Monitoring processes 578 and 588, respectively, may or may not be used to process all of the feature vectors 580. In some cases, the Monitoring process could be disabled entirely until the Learning process 578 has had a chance to learn the cold storage device's characteristics over some minimum time period of, say, several days. After that minimum time period, Monitoring could begin. At that point, Learning could either stop altogether, or could continue for some other minimum duration or perhaps forever.

The "Alert Gen" module 598 could generate an "unrecognized operating state" alarm condition when the distance between a feature vector and its nearest cluster is excessively large or when the feature vector falls outside of some appropriate detection region. This alarm could be used as a "catchall" alarm in case an abnormality wasn't detected via some other means. The "Alert Gen" module 598 may also generate a "device disconnected from AC power" alarm when the RMS current is abnormally low for some period of time.

The algorithm 560 may detect an electrical current surge by looking for feature vectors indicating large spikes in the transient current level—levels that are significantly higher than the cold storage device exhibits during normal operation. When this condition is detected, the monitor could notify the user via the server 20 that a large surge in current was detected that could have damaged the cold storage device.

In some cases when an alarm threshold is breached and an alarm notification is sent, the algorithm 560 cannot determine with certainty whether the cold storage device has indeed malfunctioned or if the detected behavior is in fact normal and acceptable. In such cases, the alarm notification sent to the user may give the user a way to provide feedback on which is the case. For example, if an abnormal compressor duty cycle is detected, the alarm message sent to the user via a text message could read "An abnormally high compressor duty cycle on freezer XYZ was detected. Please respond with an "OK" if the freezer seems to be behaving normally." When the user feedback indicates that the cold storage device is behaving normally, the monitor could pass any feature vectors that have accumulated since the alarm was triggered through the Learning process 578 to ensure that the new behavior is included in the learning statistics and that the alarm doesn't retrigger again in the future.

The algorithm 560 could also give the user the ability to clear its learning state and re-start the Learning process 578 via a user interface. This could be useful if the system was just repaired or serviced and is now known to be in a healthy state.

Figure 9:
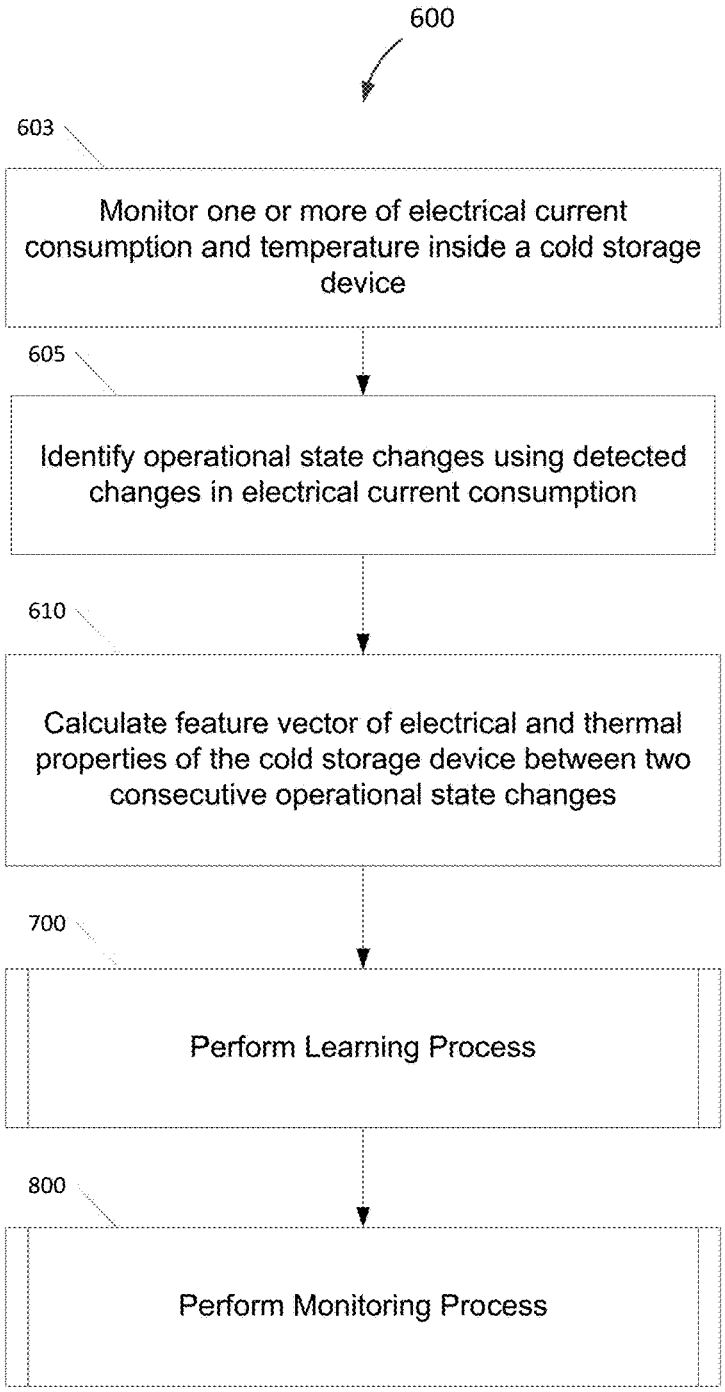
FIG. 9 is a flow chart showing a procedure for operating state detection for a cold storage device, in accordance with an example embodiment.

Reference is now made to FIG. 9. FIG. 9 illustrates a high-level flow chart of a method 600 for determining the operating state of a cold storage device, according to the embodiments presented herein. At 603, electrical current consumption and temperature inside a cold storage device are monitored. At 605, operational state changes of the cold storage device using detected changes in the electrical current consumption are detected. Also in step 605, the detected changes in the electrical current consumption are time-stamped on a system clock. At 610, a feature vector is computed of electrical and thermal properties of the cold storage device between two consecutive operational state changes. Operation 700 is a learning process that is performed, and operation 800 is a monitoring process that is performed based on output of the learning process 700.

Figure 10:
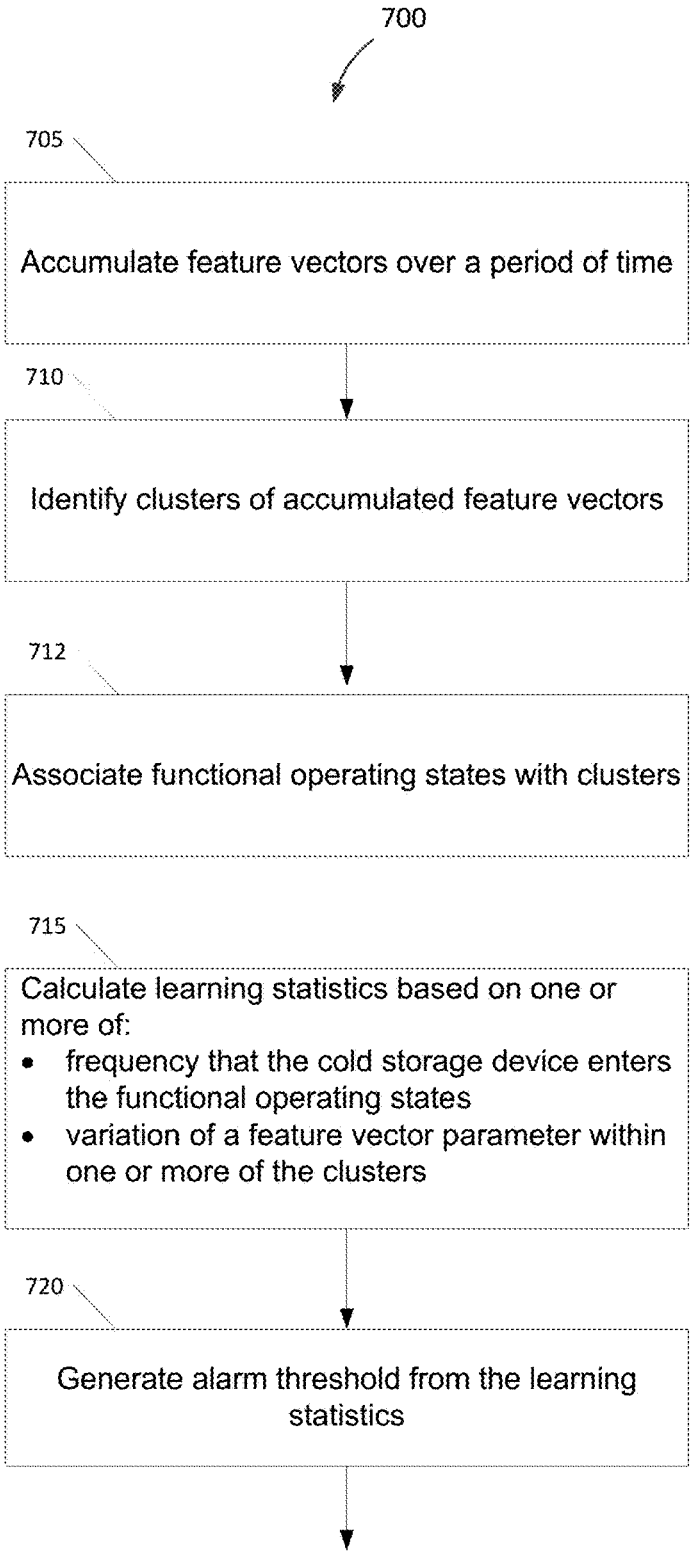
FIG. 10 is a flow chart showing a procedure for the learning process used in the operating state detection procedure of FIG. 9, in accordance with an example embodiment.

FIG. 10 illustrates a flow chart for the learning process 700 according to one embodiment. At 705, the feature vectors (computed at 610 in FIG. 9) are accumulated over a period of time. The time-stamps computed in step 605 that are associated with each feature vector are also accumulated as well. At 710, clusters of the accumulated feature vectors are identified. At 712, one or more functional operating states of the cold storage device are associated with one or more of the clusters. At 715, learning statistics are computed based on one or more of either a frequency (how often) that the cold storage device enters the functional operating states, or a variation of a feature vector parameter within one more of the clusters. At 720, an alarm threshold is generated for the parameter from the calculated statistics.

Figure 11:
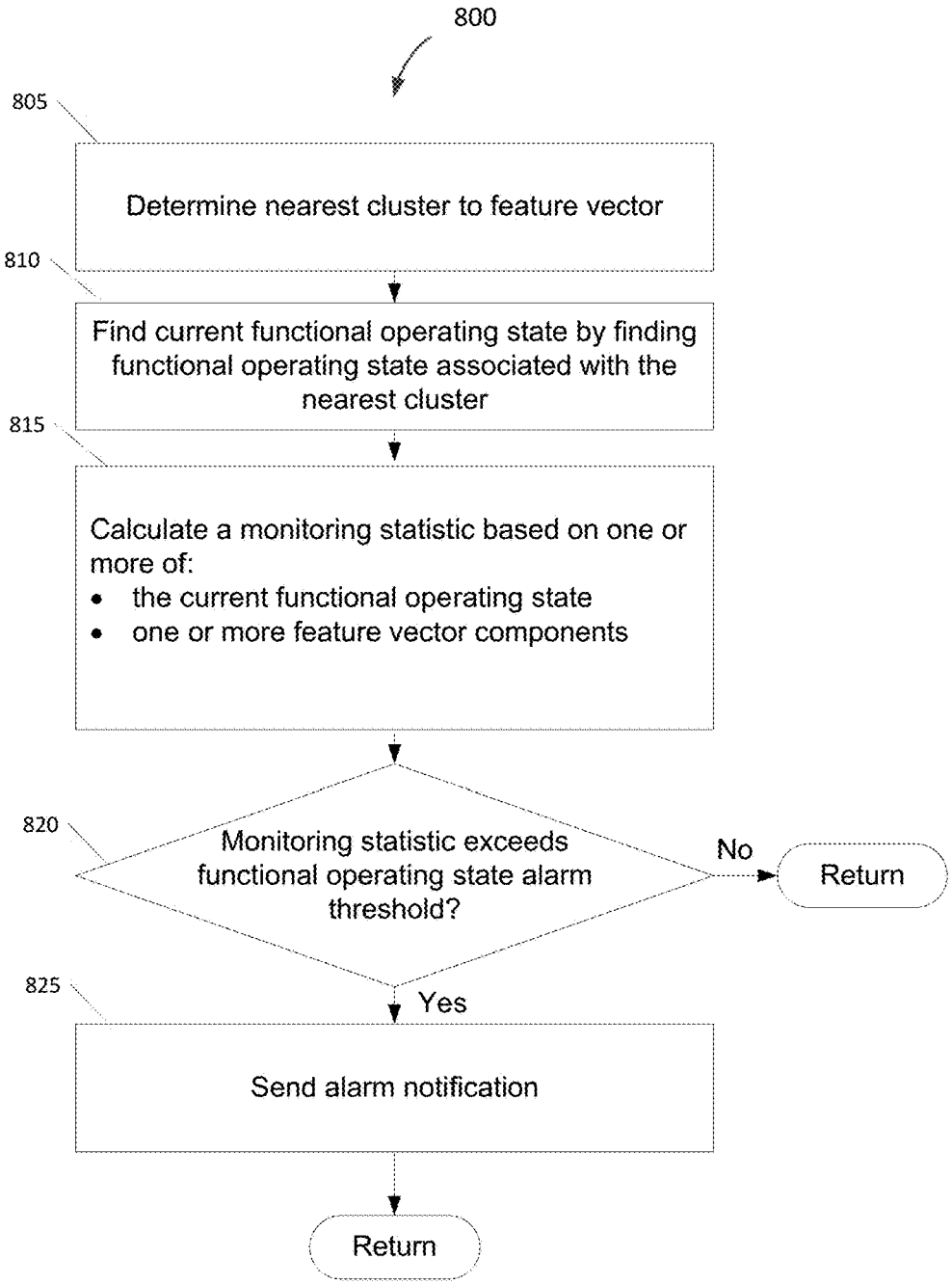
FIG. 11 is a flow chart showing a procedure for the monitoring process used in the operating state detection procedure of FIG. 9, in accordance with an example embodiment.

FIG. 11 illustrates a flow chart for the monitoring process 800 according to one embodiment. At 805, a nearest cluster to the feature vector is determined. At 810, the current functional operating state of the cold storage device is determined by noting the functional operating states associated with nearest cluster, as determined at 712. At 815, a monitoring statistic is computed based on either the current functional operating state (determined at 810) or one or more of the feature vector components. At 820, it is determined whether the monitoring statistic (determined at 815) exceeds an alarm threshold (generated at 720). If the alarm threshold is exceeded, an alarm notification is generated and sent at 825.

As described herein, the functional operating states may include one or more of: compressor or defroster of the cold storage device is on; one or more dampers of the cold storage device are open; one or more fans of the cold storage device are on; or one or more door lights of the cold storage device are on.

The learning statistics may include one or more of: compressor duty cycle, compressor on duration, compressor off duration, compressor period, defroster duty cycle, defroster on duration, defroster off duration, defroster period, compressor and defroster off current, rate-of-cooling when compressor on, rate-of-heating when compressor off, max temp when defroster on, rate-of-heating when defroster on.

The alarm notifications may include one or more of: compressor powered on for an unusually large time period, compressor powered off for unusually large time period, short-term average compressor duty cycle uncharacteristically high or low, long-term average compressor duty cycle uncharacteristically high or low, uncharacteristically low rate of cooling when compressor powered on, abnormal rate of heating when defroster powered on, abnormal rate of heating when compressor powered off, unexpected defroster "on" duration, missing defrost cycle, unexpected defroster "off" duration, irregular compressor power-up transient behavior, irregular compressor current consumption while powered on, or unexpected defroster current consumption.

The feature vector may include a component for the temperature inside the cold storage device, wherein the alarm thresholds include thresholds to indicate a temperature out-of-range condition inside the cold storage device, wherein the functional operating states include a defroster of the cold storage device is on, and wherein different values for the temperature alarm thresholds are used when the defroster has recently been determined to be on versus otherwise.

The methods presented herein may determine whether there is a defroster in the cold storage device. For example, referring back to FIG. 7, if, during the Learning period there isn't a sufficiently large number of feature vectors containing characteristics that are typically associated with a defroster, the algorithm could conclude that the cold storage device either doesn't have a defroster or if it does, that the defroster is broken. Such characteristics could include one or more of the following: relatively small current spike level, relatively large post-transient current level, relatively small ratio of current spike amplitude to post-transient current levels, relatively small decrease in temperature (or more typically an increase in temperature) during the time covered by the feature vector.

In one form, the feature vector may include a component for the temperature inside the cold storage device, wherein the alarm thresholds include thresholds to indicate a temperature-too-high condition inside the cold storage device and the length of time that the temperature has been too high, wherein the functional operating states include whether the compressor is on, wherein sending includes sending an alarm notification a period of time after a temperature-too-high condition has been detected and the cold storage device's compressor is determined to be powered on, and sending an alarm notification immediately and without delay if the compressor is determined to not be powered on when the temperature-out-of-range condition is first detected.

In still another form, the feature vector may include a component for the temperature inside the cold storage device, wherein the alarm thresholds include thresholds to indicate a temperature out-of-range condition inside the cold storage device, wherein the functional operating states include whether the defroster is on, and wherein different values for the temperature alarm thresholds are used when the defroster has recently been determined to be on versus otherwise.

In yet another form, the feature vector includes components for one or more of: the ambient temperature and humidity outside of the cold storage device, wherein the functional operating states include an indication of whether the compressor is on, wherein the learning statistics include the compressor duty cycle, and further comprising adjusting the functional operating state alarm thresholds as a function of one or more of the ambient temperature and humidity.

The methods presented herein may further include reading, with a radio frequency identifier (RFID) interrogator, RFID tags associated with items stored in the cold storage unit in order to determine a type of material being stored inside the cold storage device, and adjusting one or more of the alarm thresholds based on the type of material determined to be stored inside the cold storage device.

The monitoring, identifying and calculating operations may be performed on a plurality of cold storage devices. In this case, the accumulating in the learning process further includes accumulating the feature vectors over time from the plurality of cold storage devices, and wherein the calculating in the monitoring process is performed on a single cold storage device that may or may not be one of the plurality of cold storage devices.

The monitoring may further include monitoring one or more of the humidity and temperature both inside and outside the cold storage device, wherein the functional operating states include an indication of whether the compressor is on, wherein the learning and monitoring statistics include a compressor duty cycle, wherein the learning and monitoring statistics also include statistics on how the compressor duty cycle varies as a function of the one or more of the humidity and temperature both inside and outside the cold storage device, and wherein the alarm notification is used to indicate that the monitored compressor duty cycle is outside of a normal range at the current settings for the one or more of the humidity and temperature both inside and outside the cold storage device.

Further still, the feature vector may include components for one or more of: transient current overshoot level; transient current overshoot duration; post-overshoot minimum, maximum or average current level; minimum, maximum or average temperature; minimum, maximum or average temperature rate-of-change. In this case, the methods may further include determining whether an electrical surge has occurred using the transient current overshoot level and the duration and wherein sending an alert notification in the monitoring process is used indicate that an electrical surge has occurred.

In one form, the monitoring process further includes receiving from one or more recipients of the alarm notification, feedback as to whether the alarm notification is indicative of a malfunction of the cold storage device; and if the feedback indicates that the alarm notification is not indicative of a malfunction, updating the learning process using the feature vector or feature vectors that triggered the alarm notification such that the parameter that triggered the alarm notification is not deemed to be associated with a malfunction of the cold storage device.

In one form, the learning process and monitoring process may both be executed for each calculated feature vector. In another form, only one but not both of the learning process and monitoring process are executed for a subset of the calculated feature vectors.

The monitoring process may further include sending an unrecognized operating state alarm indication if the distance to the nearest cluster or cluster centroid exceeds an alarm threshold.

One well-known tradeoff with temperature monitoring systems for cold storage devices lies between the time it takes to detect a problem and false alarm probability. For example, if a monitoring system is configured to generate a temperature-out-of-range alarm if the temperature is out of range for, say, one minute, the chances for generating a false alarm could be relatively high. A false alarm could be easily generated if someone leaves the refrigerator door open for a minute or two to re-stock the refrigerator. The false alarm probability could be lowered significantly by increasing the temperature-out-of-range detection period from, say, 1 to 60 minutes. But increasing the minimum detection time in this way would also have the undesirable effect of increasing the time required to detect any legitimate issue with the refrigerator—for example, if someone leaves the refrigerator door permanently open or if the AC power becomes unplugged.

A cold storage monitor can be configured to run the operating state detection algorithms described herein to achieve improved performance relative to the detection latency vs. false alarm probability tradeoff because the cold storage monitor can monitor both temperature and electrical current.

The cold storage monitor can offer improved performance for cold storage devices equipped with an automatic defroster. For these types of cold storages devices, the temperature monitoring algorithm running in the cold storage monitor could be configured to use a different set of detection thresholds during and just after a defrost cycle than it does at all other times. For example, the temperature monitoring algorithm could be configured to generate a temperature-out-of-range alarm if the temperature in its cold storage device exceeds 8 degrees Celsius for more than 5 minutes unless it is within 30 minutes of the defroster being turned on, in which case the temperature and time thresholds could be increased to 9 degrees Celsius and 30 minutes, respectively. Using this approach, the cold storage monitor would almost always have a detection latency of at most 5 minutes for refrigerator malfunctions that cause the temperature to go out-of-range, unless the malfunction occurs within 30 minutes of the defroster going on. Since the defroster in many refrigerators goes on at most once per 1 to 3 days, this is a significant improvement.

Another way the monitor can offer improved detection latency performance involves alarming immediately if the cold storage device does not appear to be changing its functional operating state in an appropriate way. For example, as mentioned earlier, to mitigate false alarms, a relatively large detection time could be used before a temperature out-of-range alarm is generated. However, the cold storage monitor could alarm right away if the temperature is too high and the compressor has not been turned on, or if the temperature is too low and the compressor has not been turned off since in both of these cases, it is not 100% certain there is a malfunction and there is no need to wait extra time to prevent a false alarm.

In a large-scale implementation containing a large number of cold storage monitors and cold storage devices, characteristics from multiple instances of the same cold storage device could be used to detect performance problems. For example, the server 20 (FIG. 1) might have a total of 150 monitors in various organizations that are connected to a particular model freezer. Each of the monitors could be running the operating state detection algorithms described herein, and could be configured to periodically upload operating characteristics of its host cold storage device to the server 20. If the server 20 finds that any one of these cold storage devices exhibits operating characteristics that are abnormal relative to the others, an alarm could be generated. For example, if one cold storage device has a compressor steady-state current that is significantly different from the others, an alarm could be generated.

The cold storage monitor could be configured to measure the ambient temperature outside the cold storage device and possibly also the humidity inside and outside of the cold storage device. The cold storage device will generally have to consume more energy, on average, to maintain a fixed internal temperature when there is high ambient temperature or humidity than it would otherwise. With this in mind, instead of using fixed alarm thresholds for an unexpected compressor duty cycle alarm, a performance improvement could be realized if the cold storage monitor made the alarm thresholds vary as a function of one or more of the internal operating temperature, external ambient temperature and external humidity. A cold storage monitor could build data in a table over time characterizing how the mean compressor duty cycle varies as a function of these three variables and generate an alarm if the duty cycle exceeds the mean at a particular temp and humidity by an appropriate threshold (e.g., 2 standard deviations). To further improve performance, the data could be stored in a database on the server 20 and could be built from multiple instances of the same cold storage device (i.e., multiple instances from the same manufacturer and model number).

The operating state detection procedure 600 is further described using an example based on current and temperature data taken from a pharmaceutical refrigerator over a period of 7 days. Reference is made to FIGS. 9 and 10 for purposes of describing this example. For simplicity, this example uses a two dimensional feature vector. The first element of the feature vector represents the peak transient current overshoot, defined more specifically in this example as the max current consumption seen within the first five minutes of each detected operating state change. The second element represents the steady-state current consumption after the initial transient has disappeared. The steady-state current consumption is computed in this example by computing the mean current level over the last 10 minutes of each detected operating state transition interval.

Figure 12A:
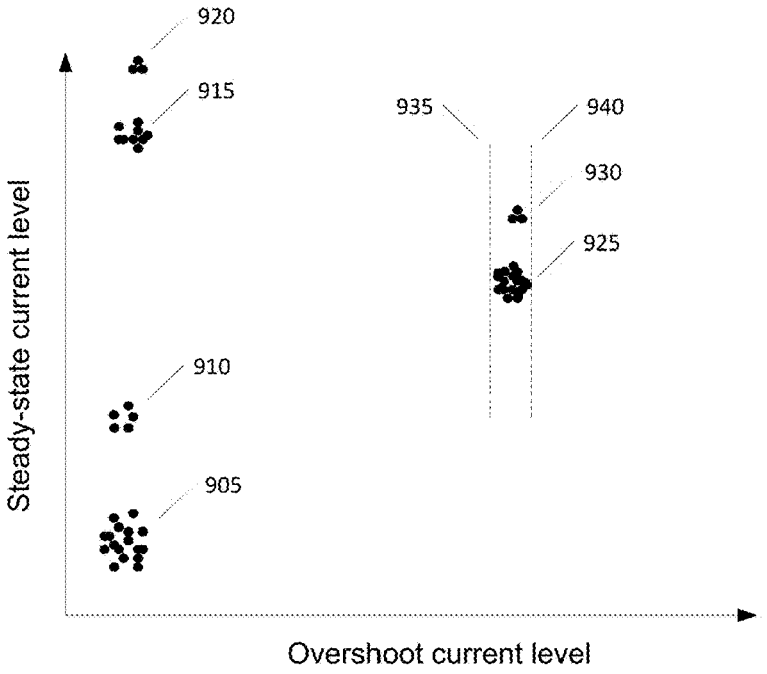
FIG. 12*a* is scatter plot showing feature vectors computed from current and temperature data taken from a pharmaceutical refrigerator over a period of 7 days, in accordance with an example embodiment.

Using the above feature vector definition, FIG. 12*a* shows a scatter plot of all feature vectors obtained by monitoring the electrical current consumption of the pharmaceutical refrigerator (step 603 of FIG. 9) for a period of 7 days, identifying operational state changes of the refrigerator using detected transitions in the current consumption (step 605), calculating the feature vector components/elements (step 610), and accumulating the feature vectors over a period of time (step 705, performed for 7 days). The feature vectors in this example can be seen to occupy one of 6 clusters, labeled 905, 910, 915, 920, 925 and 930 in FIG. 12*a*. Each of the 6 clusters in this example can be shown to be associated with each unique combination of functional operating states of the refrigerator. The refrigerator in this example has a compressor, a defroster, and a door light. Its functional operating states are all eight combinations of the compressor, defroster and door light being on or off, except two of these combinations (compressor=defroster=on; light=on or off) are invalid and do not occur, as the designer or this refrigerator has designed it so that the compressor and defroster do not turn on at the same time.

The feature vectors in cluster 905 have a relatively small amount of current overshoot, and a small steady-state current level, and are therefore associated with the compressor, defroster and door light all being turned off. Cluster 910 has a low overshoot but slightly larger steady-state current, and is therefore associated with the compressor and defroster being off and door light being on. Clusters 915 and 920 are associated with the defroster being on while the compressor is off. The door light is off for vectors in cluster 915 and on for those in cluster 920. Clusters 925 and 930 are associated with the compressor being on while the defroster is off; the door light is off for vectors in cluster 925 and on for those in cluster 930.

Figure 12B:
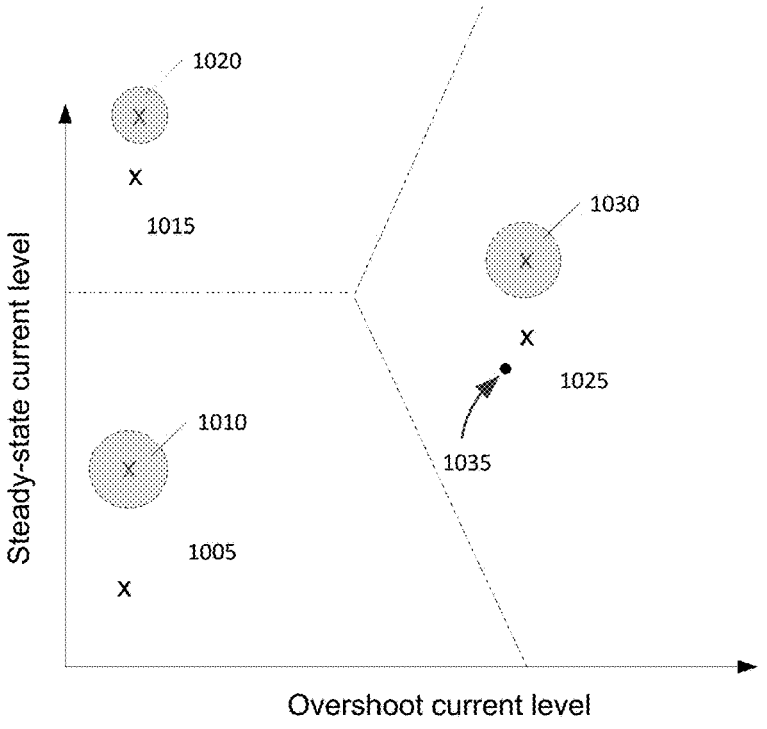
FIG. 12*b* is a plot showing decision regions and centroids for each of the scatter-point clusters in FIG. 12*a*.

The learning process step 710 of identifying clusters of accumulated feature vectors using any one of a number of well-known clustering algorithms would identify the 6 clusters 905, 910, 915, 920, 925 and 930 shown in FIG. 12*a*. The clustering algorithm would also generate a set of six decision regions: 1005, 1010, 1015, 1020, 1025 and 1030 in FIG. 12*b*. The "x" symbols in FIG. 12*b* represent the centroid of each cluster.

The step 712 of associating functional operating states with clusters would assign all clusters having a relatively high current overshoot level and a medium-to-high steady-state current level (since this is characteristic of the compressor being on) to the "defroster off, compressor on" functional operating state. Since there are two such clusters (925 and 930) in this example, the cluster having the higher steady-state level (930) would be assigned to the "defroster off, compressor on, door light on" operating state; the cluster having the lower steady-state level (925) would be assigned to the "defroster off, compressor on, door light off" state. The associating step 712 would further assign any clusters having a low overshoot current and low steady-state current (characteristics of the compressor being off and defroster being on—clusters 905 and 910 in this example) to the "defroster off, compressor off, door light on" and "defroster off, compressor off, door light off" states, and assign any clusters having a high steady-state current and low overshoot current to the "defroster on, compressor off, door light on" and "defroster on, compressor off, door light off" states. The functional operating states and decision regions associated with each of the six clusters for this example are summarized in table 1050 of FIG. 13.

Figure 14:
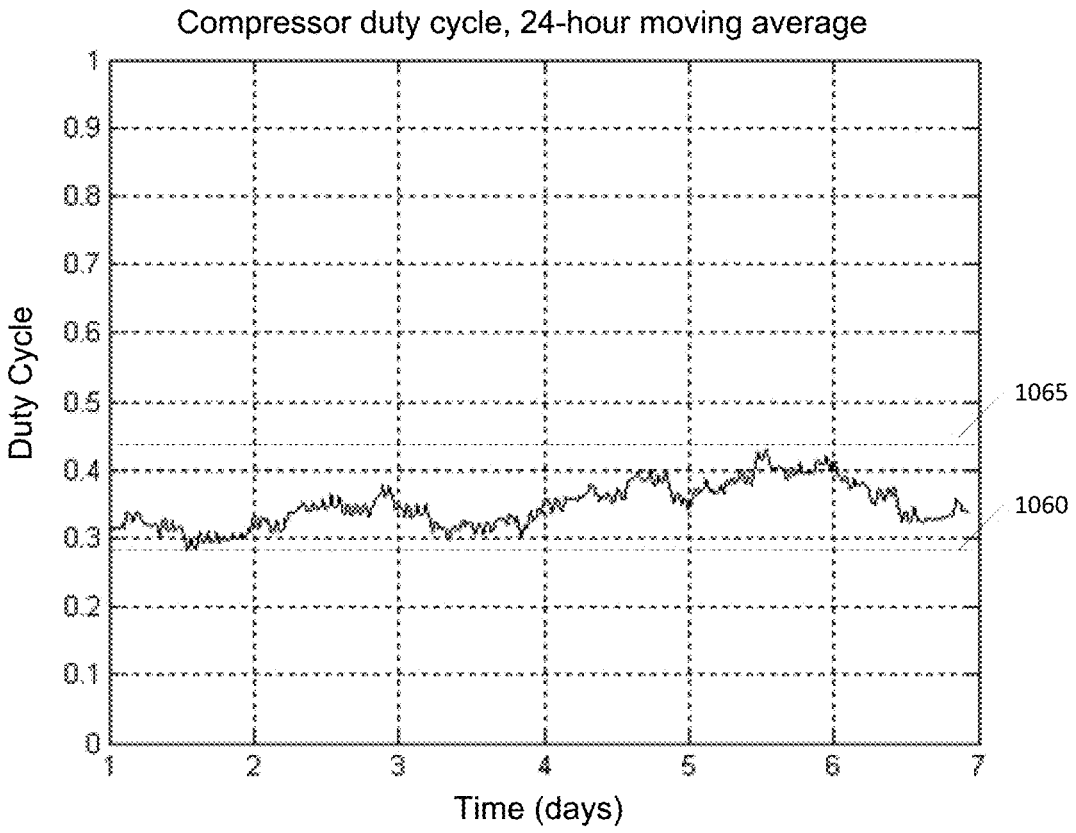
FIG. 14 shows a plot of a 24 hour moving average compressor duty cycle computed over a period of 6 days, in accordance with an example embodiment.

In steps 715 and 720 of the learning process, learning statistics are calculated from which alarm thresholds are generated. There are two learning statistics used in this example: compressor duty cycle, and min/max overshoot. FIG. 14 shows a plot of the refrigerator's compressor duty cycle, computed as a 24 hour moving average of the percentage of time that the compressor was in the on state (i.e., the time over which the monitored feature vectors occupied decision regions 1025 or 1030) over the for the last 6 days of the 7 day learning period. The alarm thresholds for compressor duty cycle are derived by computing the max and compressor duty cycle during the learning period and adding or subtracting a small offset to each to prevent false alarms. The max and min duty cycles for this example are 28% and 42%, respectively, as shown at 1060 and 1065 of FIG. 14. The alarm thresholds could be set slightly lower and higher than these values to avoid false alarms—say, to 25% and 45%.

Referring back to FIG. 12*a*, the alarm thresholds for compressor overshoot for this example are derived by computing the max 940 and min 935 compressor overshoot level for compressor from clusters 925 and 930 obtained during the learning process, and adding/subtracting a small offset to prevent false alarms.

Turning again to FIG. 12*b*, data point 1035 shows a feature vector received while executing the monitoring process 800 (shown in FIG. 11) for this example. In step 805, the step of determining the nearest cluster to the feature vector, since the data point occupies decision region 1025, the nearest cluster is determined to be cluster 925. In step 810, the functional operating state is found from data such as that shown in table 1050 of FIG. 13 to be "compressor on, defroster on, door light off". In step 815, the monitoring statistic for compressor duty cycle is updated by adding the duration of the time interval represented by feature vector 1035 (this can be computed because all operational state changes identified in the identifying step 605 of the operating state detection procedure 600 (FIG. 9) are time-stamped, as mentioned earlier) to the amount of time the compressor has been on in the past 24 hours, dividing by 24 hours to obtain the 24 hour moving average statistic for compressor duty cycle. Also in step 815, the monitoring statistic for current overshoot is computed by simply extracting the overshoot level from data point 1035.

Step 820 of the monitoring process compares the current overshoot level extracted from feature vector 1035 to the min and max alarm thresholds for current overshoot generated from the learning process, and generates an alarm notification if either threshold is breached. Also in step 820, the 24 hour moving average compressor duty cycle is compared to the min and max alarm thresholds from the learning process, and generates an alarm notification if either threshold is breached.

The foregoing description of the example depicted with reference to FIGS. 12*a*, 12*b*, 13 and 14 is meant for example purposes only.

In one form, a method is provided. The method determines the operating state of a cold storage device, and comprises: monitoring electrical current consumption and temperature inside a cold storage device; identifying operational state changes of the cold storage device using detected changes in the electrical current consumption; calculating a multi-dimensional feature vector comprising a plurality of electrical and thermal parameters derived from the monitored electrical current consumption and temperature of the cold storage device between consecutive operational state changes; performing a learning process that includes: accumulating feature vectors over a period of time; identifying clusters of accumulated feature vectors; associating one or more functional operating states of the cold storage device with one or more of the clusters; calculating learning statistics based on one or more of: a frequency that the cold storage device enters the one or more functional operating states; a variation of a feature vector parameter within one or more of the clusters; and generating an alarm threshold from the learning statistics; performing a monitoring process that includes: determining a nearest cluster to the feature vector; determining one or more current functional operating states of the cold storage device from the functional operating states associated with the nearest cluster; calculating a monitoring statistic based on one or more of: the one or more current functional operating states; one or more feature vector components; and sending an alarm notification if the monitoring statistic exceeds the alarm threshold.

The embodiments may take the form of a system. The system comprises: a monitoring device configured to monitor one or more of electrical current consumption and temperature inside a cold storage device; and a server coupled to the monitoring device, wherein the server is configured to perform operations including: identifying operational state changes of the cold storage device using detected changes in the electrical current consumption; calculating a multi-dimensional feature vector comprising a plurality of electrical and thermal parameters derived from the monitored electrical current consumption and temperature of the cold storage device between consecutive operational state changes; performing a learning process that includes: associating one or more functional operating states of the cold storage device with one or more of the clusters; calculating learning statistics based on one or more of: a frequency that the cold storage device enters the one or more functional operating states; a variation of a feature vector parameter within one or more of the clusters; and generating an alarm threshold from the learning statistics; performing a monitoring process that includes: determining a nearest cluster to the feature vector; determining one or more current functional operating states of the cold storage device from the functional operating states associated with the nearest cluster; calculating a monitoring statistic based on one or more of: the one or more current functional operating states; one or more feature vector components; and sending an alarm notification if the monitoring statistic exceeds the alarm threshold.

In addition, the embodiments presented herein may take the form of one or more non-transitory computer readable storage media encoded with instructions, that when executed by a processor, cause the processor to perform operations including: monitoring electrical current consumption and temperature inside a cold storage device; identifying operational state changes of the cold storage device using detected changes in the electrical current consumption; calculating a multi-dimensional feature vector comprising a plurality of electrical and thermal parameters derived from the monitored electrical current consumption and temperature of the cold storage device between consecutive operational state changes; performing a learning process that includes: associating one or more functional operating states of the cold storage device with one or more of the clusters; calculating learning statistics based on one or more of: a frequency that the cold storage device enters the one or more functional operating states; a variation of a feature vector parameter within one or more of the clusters; and generating an alarm threshold from the learning statistics; performing a monitoring process that includes: determining a nearest cluster to the feature vector; determining one or more current functional operating states of the cold storage device from the functional operating states associated with the nearest cluster; calculating a monitoring statistic based on one or more of: the one or more current functional operating states; one or more feature vector components; and sending an alarm notification if the monitoring statistic exceeds the alarm threshold.

From the above description, those skilled in the art will perceive improvements, changes and modifications. Such improvements, changes and modifications are within the skill of one in the art and are intended to be covered by the appended claims.

What is claimed is:

1. A method for determining the operating state of a cold storage device, comprising:

monitoring electrical current consumption and temperature inside a cold storage device;

identifying operational state changes of the cold storage device using detected changes in the electrical current consumption;

calculating a multi-dimensional feature vector comprising a plurality of electrical and thermal parameters derived from the monitored electrical current consumption and temperature of the cold storage device between consecutive operational state changes;

performing a learning process that includes:

accumulating feature vectors over a period of time;

identifying clusters of accumulated feature vectors;

associating one or more functional operating states of the cold storage device with one or more of the clusters;

calculating learning statistics based on one or more of:

a frequency that the cold storage device enters the one or more functional operating states;

a variation of a feature vector parameter within one or more of the clusters; and generating an alarm threshold from the learning statistics;

performing a monitoring process that includes:

determining a nearest cluster to the feature vector;

determining one or more current functional operating states of the cold storage device from the functional operating states associated with the nearest cluster;

calculating a monitoring statistic based on one or more of:

the one or more current functional operating states;

one or more feature vector components; and sending an alarm notification if the monitoring statistic exceeds the alarm threshold.

2. The method of claim 1, wherein the functional operating states include one or more of:

compressor on, compressor off, defroster on, defroster off, damper open, damper closed, fan on, fan off, door open, door closed, door light on, or door light off.

3. The method of claim 1, wherein the learning statistics include one or more of the mean, standard deviation, median, maximum or minimum of the following:

compressor duty cycle, compressor on duration, compressor off duration, compressor period, defroster duty cycle, defroster on duration, defroster off duration, defroster period, compressor and defroster off current, rate-of-cooling when compressor on, rate-of-heating when compressor off, temperature when defroster on, and rate-of-heating when defroster on.

4. The method of claim 1, wherein the alarm notification includes one or more of:

compressor powered on for an unusually large time period, compressor powered off for unusually large time period, short-term average compressor duty cycle uncharacteristically high or low, long-term average compressor duty cycle uncharacteristically high or low, uncharacteristically low rate of cooling when compressor powered on, abnormal rate of heating when defroster powered on, abnormal rate of heating when compressor powered off, unexpected defroster "on" duration, missing defrost cycle, unexpected defroster "off" duration, irregular compressor power-up transient behavior, irregular compressor current consumption while powered on, or unexpected defroster current consumption.

5. The method of claim 1, wherein the feature vector includes a component for the temperature inside the cold storage device, wherein the alarm thresholds include thresholds to indicate a temperature out-of-range condition inside the cold storage device, wherein the functional operating states include a defroster of the cold storage device is on, and wherein different values for the temperature alarm thresholds are used when the defroster has recently been determined to be on versus otherwise.

6. The method of claim 1, wherein the feature vector includes a component for the temperature inside the cold storage device, wherein the alarm thresholds include thresholds to indicate a temperature-too-high condition inside the cold storage device and the length of time that the temperature has been too high, wherein the functional operating states include whether the compressor is on, wherein sending includes sending an alarm notification a period of time after a temperature-too-high condition has been detected and the cold storage device's compressor is determined to be powered on, and sending an alarm notification immediately and without delay if the compressor is determined to not be powered on when the temperature-out-of-range condition is first detected.

7. The method of claim 1, further comprising reading, with an RFID interrogator, RFID tags associated with items stored in the cold storage unit in order to determine a type of material being stored inside the cold storage device, and adjusting one or more of the alarm thresholds based on the type of material determined to be stored inside the cold storage device.

8. The method of claim 1, wherein the feature vector includes a component for the temperature inside the cold storage device, wherein the alarm thresholds include thresholds to indicate a temperature out-of-range condition inside the cold storage device, wherein the functional operating states include whether the defroster is on, and wherein different values for the temperature alarm thresholds are used when the defroster has recently been determined to be on versus otherwise.

9. The method of claim 1, wherein the feature vector includes components for one or more of the ambient temperature and humidity outside of the cold storage device, wherein the functional operating states include an indication of whether the compressor is on, wherein the learning statistics include the compressor duty cycle, and further comprising adjusting the functional operating state alarm thresholds as a function of one or more of the ambient temperature and humidity.

10. The method of claim 1, wherein the monitoring, identifying, and calculating are performed on a plurality of cold storage devices, wherein the accumulating in the learning process further includes accumulating the feature vectors over time from the plurality of cold storage devices, and wherein the calculating in the monitoring process is performed on a single cold storage device that may or may not be one of the plurality of cold storage devices.

11. The method of claim 1, wherein monitoring further includes monitoring one or more of the humidity and temperature both inside and outside the cold storage device, wherein the functional operating states include an indication of whether the compressor is on, wherein the learning and monitoring statistics include a compressor duty cycle, wherein the learning and monitoring statistics also include statistics on how the compressor duty cycle varies as a function of the one or more of the humidity and temperature both inside and outside the cold storage device, and wherein the alarm notification is used to indicate that the monitored compressor duty cycle is outside of a normal range at the current settings for the one or more of the humidity and temperature both inside and outside the cold storage device.

12. The method of claim 1, wherein the feature vector includes components for one or more of: transient current overshoot level; transient current overshoot duration; post-overshoot minimum, maximum or average current level; minimum, maximum or average temperature; minimum, maximum or average temperature rate-of-change.

13. The method of claim 12, further comprising determining whether an electrical surge has occurred using the transient current overshoot level and the duration and wherein sending an alert notification in the monitoring process is used to indicate that a an electrical surge has occurred.

14. The method of claim 1, wherein the monitoring process further comprises:

receiving from one or more recipients of the alarm notification, feedback as to whether the alarm notification is indicative of a malfunction of the cold storage device; and if the feedback indicates that the alarm notification is not indicative of a malfunction, updating the learning process using the feature vector or feature vectors that triggered the alarm notification such that the parameter that triggered the alarm notification is not deemed to be associated with a malfunction of the cold storage device.

15. The method of claim 1, wherein the learning process and monitoring process are both executed for each calculated feature vector.

16. The method of claim 1, wherein only one but not both of the learning process and monitoring process are executed for a subset of the calculated feature vectors.

17. The method of claim 1, wherein the monitoring process further includes sending an unrecognized operating state alarm indication if the distance to the nearest cluster exceeds an alarm threshold.

18. A system comprising:

a monitoring device configured to monitor one or more of electrical current consumption and temperature inside a cold storage device;

a server coupled to the monitoring device, wherein the server is configured to perform operations including:

identifying operational state changes of the cold storage device using detected changes in the electrical current consumption;

calculating a multi-dimensional feature vector comprising a plurality of electrical and thermal parameters derived from the monitored electrical current consumption and temperature of the cold storage device between consecutive operational state changes;

performing a learning process that includes:

accumulating feature vectors over a period of time;

identifying clusters of accumulated feature vectors;

associating one or more functional operating states of the cold storage device with one or more of the clusters;

calculating learning statistics based on one or more of:

a frequency that the cold storage device enters the one or more functional operating states;

a variation of a feature vector parameter within one or more of the clusters; and generating an alarm threshold from the learning statistics;

performing a monitoring process that includes:

determining a nearest cluster to the feature vector;

determining one or more current functional operating states of the cold storage device from the functional operating states associated with the nearest cluster;

calculating a monitoring statistic based on one or more of:

the one or more current functional operating states;

one or more feature vector components; and sending an alarm notification if the monitoring statistic exceeds the alarm threshold.

19. The system of claim 18, wherein the functional operating states include one or more of:

compressor on, compressor off, defroster on, defroster off, damper open, damper closed, fan on, fan off, door open, door closed, door light on, or door light off.

20. One or more non-transitory computer readable storage media encoded with instructions, that when executed by a processor, cause the processor to perform operations including:

monitoring electrical current consumption and temperature inside a cold storage device;

identifying operational state changes of the cold storage device using detected changes in the electrical current consumption;

calculating a multi-dimensional feature vector comprising a plurality of electrical and thermal parameters derived from the monitored electrical current consumption and temperature of the cold storage device between consecutive operational state changes;

performing a learning process that includes:

accumulating feature vectors over a period of time;

identifying clusters of accumulated feature vectors;

associating one or more functional operating states of the cold storage device with one or more of the clusters;

calculating learning statistics based on one or more of:

a frequency that the cold storage device enters the one or more functional operating states;

a variation of a feature vector parameter within one or more of the clusters; and generating an alarm threshold from the learning statistics;

performing a monitoring process that includes:

determining a nearest cluster to the feature vector;

determining one or more current functional operating states of the cold storage device from the functional operating states associated with the nearest cluster;

calculating a monitoring statistic based on one or more of:

the one or more current functional operating states;

one or more feature vector components; and sending an alarm notification if the monitoring statistic exceeds the alarm threshold.

* * * * *